US009968860B2

(12) United States Patent
Shindo

(10) Patent No.: US 9,968,860 B2
(45) Date of Patent: May 15, 2018

(54) COMBINED LAUNCHING DEVICE FOR LAUNCHING SPINNING TOPS

(71) Applicant: TOMY COMPANY, LTD., Tokyo (JP)

(72) Inventor: Yukihiro Shindo, Inagi (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days. days.

(21) Appl. No.: 15/165,240

(22) Filed: May 26, 2016

(65) Prior Publication Data

US 2017/0173477 A1 Jun. 22, 2017

(30) Foreign Application Priority Data

Dec. 16, 2015 (JP) ..... 2015-245219

(51) Int. Cl.
*A63H 1/06* (2006.01)
*A63H 1/04* (2006.01)

(52) U.S. Cl.
CPC ..... *A63H 1/04* (2013.01)

(58) Field of Classification Search
CPC ..... A63H 1/00; A63H 1/02; A63H 1/18
USPC ..... 446/239, 247, 257, 259
See application file for complete search history.

(56) References Cited

U.S. PATENT DOCUMENTS 1,552,530 A * 9/1925 Woods ..... A63F 9/16 273/108
1,907,419 A * 5/1933 Wetzell ..... A63H 1/02 446/257
2,068,053 A * 1/1937 Gehman ..... A63H 1/18 446/257

(Continued)

FOREIGN PATENT DOCUMENTS

JP S50-120599 3/1974
JP 2-13595 1/1990

(Continued)

OTHER PUBLICATIONS

J-Plat Pat English Language Abstract of Japanese Publication No. 02-156979, Published Jun. 15, 1990.

(Continued)

*Primary Examiner* — Melba Bumgarner
*Assistant Examiner* — Joseph B Baldori
(74) *Attorney, Agent, or Firm* — Staas & Halsey LLP

(57) ABSTRACT

A combined launching device for launching spinning tops, includes a first launching unit and a second launching unit. Each launching unit includes a casing. The casing accommodates a spinning top holder for holding a spinning top and a spinning mechanism, wherein the spinning mechanism is operated to spin and launch the spinning top by linearly and manually moving an operating member in a predetermined operating direction, wherein the casing of the first launching unit has a first coupler, and the casing of the second launching unit has a second coupler removably combined with the first coupler, and wherein the first launching unit is combined with the second launching unit such that the first and second spinning top holders face in the same direction and the predetermined operating direction of the operating member is the same for the first and second launching units.

2 Claims, 4 Drawing Sheets

(56) References Cited

U.S. PATENT DOCUMENTS 2,633,664 A * 4/1953 Neilson ..... A63H 1/18 446/257
2,966,004 A * 12/1960 Schustrin ..... A63H 1/02 446/257
3,246,424 A * 4/1966 Gregory ..... A63H 27/14 446/40
3,449,859 A * 6/1969 Neilson ..... A63H 1/18 446/257
3,594,943 A * 7/1971 Ryan ..... A63H 1/00 446/257
3,701,216 A * 10/1972 Smith, III ..... A63F 7/2472 185/39
3,815,911 A * 6/1974 Cooper ..... A63F 9/16 273/108
4,043,556 A * 8/1977 Lappa ..... A63B 67/00 273/445
D246,197 S * 10/1977 Iwanami ..... D21/590
4,867,728 A * 9/1989 Moomaw ..... A63H 29/24 446/257
5,017,172 A * 5/1991 Seifert ..... A63H 1/30 446/250
D353,848 S * 12/1994 Nonaka ..... D21/461
5,518,437 A * 5/1996 Nonaka ..... A63H 1/02 446/259
6,364,734 B1 * 4/2002 Ng ..... A63H 1/18 446/236
6,739,939 B2 * 5/2004 Matsukawa ..... A63F 3/00895 446/256
6,743,070 B1 * 6/2004 Lin ..... A63H 1/02 446/15
6,905,389 B2 * 6/2005 Matsukawa ..... A63F 3/00895 446/256
8,715,032 B2 * 5/2014 Horikoshi ..... A63H 1/12 446/256
8,795,027 B2 * 8/2014 Kelderhouse ..... A63H 29/16 446/228
2006/0148373 A1 * 7/2006 Vetuskey ..... A63H 17/008 446/73
2006/0211331 A1 * 9/2006 Trageser ..... A63H 29/24 446/429
2011/0177750 A1 * 7/2011 Ujita ..... A63H 1/04 446/263
2014/0329436 A1 * 11/2014 Lennon ..... A63H 17/008 446/429
2015/0017872 A1 * 1/2015 Choi ..... A63H 1/04 446/259
2016/0175721 A1 * 6/2016 Choi ..... A63H 1/04 446/259

FOREIGN PATENT DOCUMENTS

JP 2-156979 6/1990
JP 3090580 10/2002
JP 3532904 3/2004

OTHER PUBLICATIONS

J-Plat Pat English Language Abstract of Japanese Publication No. 2003-320165, Published Nov. 11, 2003.
Extended European Search Report dated Sep. 16, 2016 in corresponding European Patent Application No. 16170807.8.

* cited by examiner

COMBINED LAUNCHING DEVICE FOR LAUNCHING SPINNING TOPS

BACKGROUND OF THE INVENTION

1. Field of the Invention

The present invention relates to a combined launching device for simultaneously launching a plurality of spinning tops.

2. Description of Related Art

A traditional launching device for launching a spinning top is configured to launch only one spinning top from a spinning top holder. When a user plays a spinning-tops combat game alone, the user has to launch a first spinning top with a launching device and launch a second one immediately after the first one. There are two ways for launching two spinning tops alone. In one way, the user prepares two launching devices each loaded with a spinning top and launches a first spinning top with one of the launching devices and then launches a second one with the other launching device. In the other way, the user launches a first spinning top with a launching device and loads a second top in the same launching device to launch it.

Both the operations are troublesome, resulting in a time lag between the launch of a first spinning top and that of a second one. Such a time lag gives an advantage to the second spinning top and impairs the game.

Japanese Utility-Model Registration No. 3090580 discloses a launching device for simultaneously launching two spinning tops.

This launching device for simultaneously launching two spinning tops includes a housing accommodating two launching units in parallel, each of which launches a spinning top. Inserting two rack belts into the respective launching units and then pulling the two rack belts together can simultaneously launch two spinning tops.

Unfortunately, the launching device disclosed in Japanese Utility-Model Registration No. 3090580 has a complicated structure including two launching units and a special housing for accommodating the two launching units in parallel.

SUMMARY OF THE INVENTION

An object of the present invention is to provide a combined launching device with a simple structure for launching spinning tops.

In order to realize the above object, according to one aspect of the present invention, there is provided a combined launching device for launching spinning tops, including:

a first launching unit including a first casing, the first casing accommodating a first spinning top holder for holding a first spinning top and a first spinning mechanism, wherein the first spinning mechanism is operated to spin and launch the first spinning top by linearly and manually moving an operating member in a predetermined operating direction; and a second launching unit including a second casing, the second casing accommodating a second spinning top holder for holding a second spinning top and a second spinning mechanism, wherein the second spinning mechanism is operated to spin and launch the second spinning top by linearly and manually moving an operating member in the predetermined operating direction, wherein the first casing of the first launching unit has a first coupler, and the second casing of the second launching unit has a second coupler removably combined with the first coupler, and the first launching unit is combined with the second launching unit such that the first and second spinning top holders face in the same direction and the predetermined operating direction of the operating member is the same for the first and second launching units.

Preferably, the operating member is a rack belt.

According to these configurations, two launching units can be separated for independent use of the individual launching units or the two launching units can be combined with each other for simultaneous launching of two spinning tops. The user can simultaneously launch two spinning tops and play a spinning-tops combat game alone with the combined launching units. This combined launching device has a simple structure.

Preferably, the first launching unit is combined with the second launching unit such that the rack belt is engaged with both of a pinion of the first spinning mechanism and a pinion of the second spinning mechanism.

According to this configuration, the combined launching units can be readily operated with one rack belt for simultaneous launching of two spinning tops.

Preferably, the first launching unit has both of the first coupler and the second coupler and the second launching unit has both of the first coupler and the second coupler.

According to this configuration, three or more launching units can be combined with each other. In the case of two launching units, these launching units can be disposed in any direction in the combined launching device.

BRIEF DESCRIPTION OF THE DRAWINGS

The present invention will become more fully understood from the detailed description given hereinafter and the accompanying drawings, which are given by way of illustration only and thus are not intended to limit the present invention, wherein.

DETAILED DESCRIPTION

Embodiments of a combined launching device for launching spinning tops according to the present invention will now be described with reference to the accompanying drawings. The front, back, right, left, up, and down directions are indicated in FIG. 1.

(Overall Structure)

Figure 1:
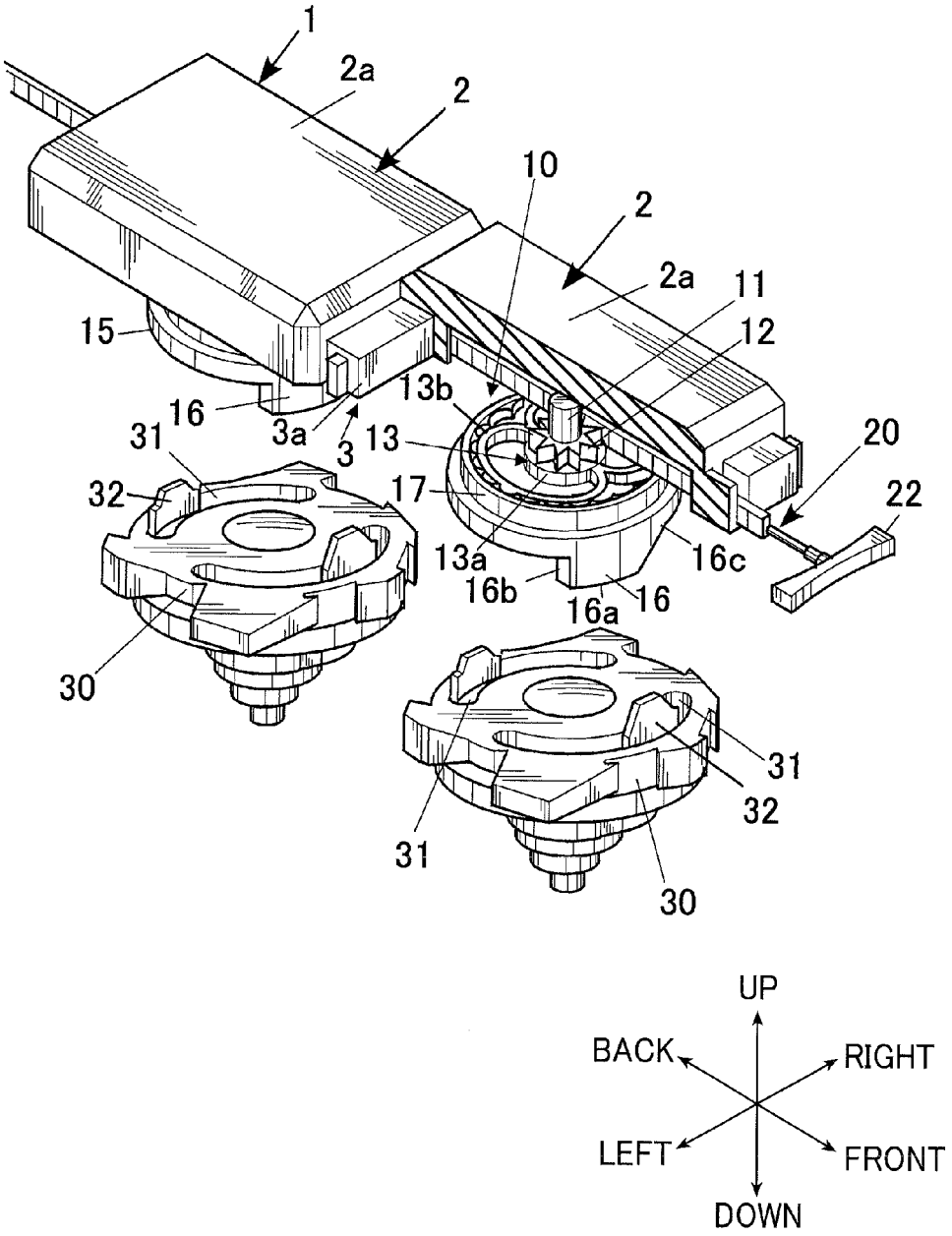
FIG. 1 is a partially cut-out perspective view of the combined launching device for launching spinning tops according to an embodiment of the present invention.

FIG. 1 illustrates a combined launching device 1 including two launching units 2 connected to each other by a coupling 3 in the longitudinal direction, for launching spinning tops.

In the combined launching device 1, each launching unit 2 is loaded with one spinning top 30.

The combined launching device 1 includes one rack belt 20. The rack belt 20 is introduced from the front launching unit 2 into the combined launching device 1 such that the front end of the rack belt 20 projects from the back launching unit 2. Pulling the rack belt 20 can simultaneously spin and launch the spinning tops 30 mounted in the launching units 2.

The combined launching device 1 can be separated into the two launching units 2 for independent use of the individual launching units 2.

(Partial Structures)

1. Launching Unit 2

In the present embodiment, the two launching units 2 have an identical structure. In the circumstances, the same reference numeral is used for identical elements of the two launching units 2 for avoiding redundancy in the description.

Figure 2:
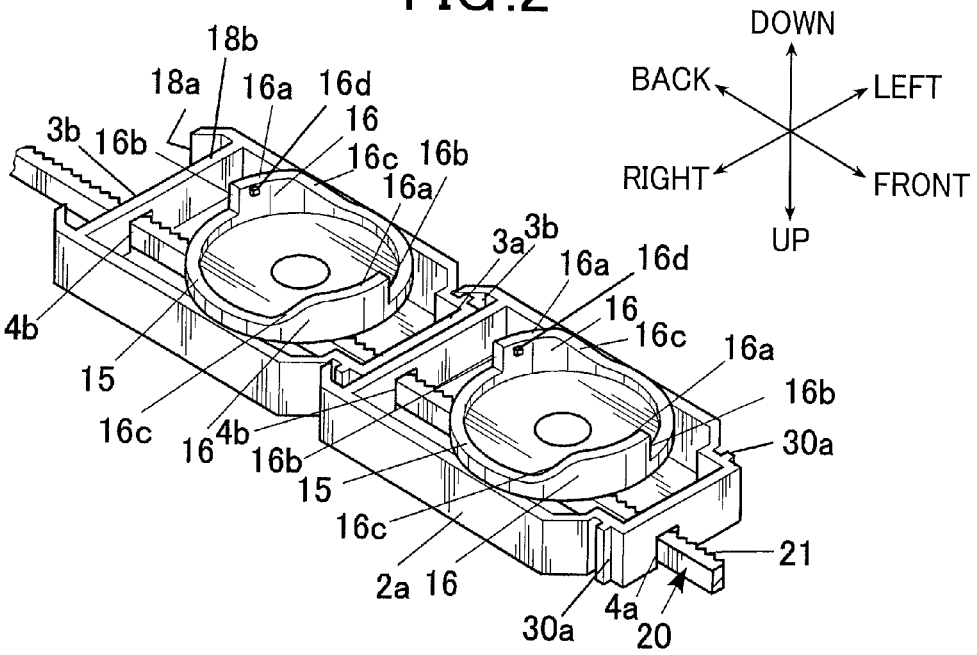
FIG. 2 is a bottom perspective view of the combined launching device illustrated in FIG. 1.

The launching unit 2 includes a casing 2*a*. The casing 2*a* is generally rectangular in top view. The casing 2*a* is open at the bottom (see FIG. 2).

The casing 2*a* has a forward projection 3*a* at the front end. The projection 3*a* is positioned in the middle of the front end of the casing 2*a* in the transverse or horizontal direction and is narrower than the casing 2*a* in the transverse direction. The projection 3*a* has a rib 30*a* on each side in the transverse direction. The ribs 30*a* project outwardly in the transverse direction. The projection 3*a* functions as a coupler.

The casing 2*a* has a cutout 18*a* at the back end. The cutout 18*a* has substantially the same width as that of the projection 3*a* in the transverse direction. The cutout 18*a* is open to the bottom. A wall 18*b* is provided in front of the cutout 18*a*. The edges of the cutout 18*a*, the wall 18*b*, and the right and left walls define a recess 3*b*. The recess 3*b* functions as another coupler.

When the projection 3*a* of the back launching unit 2 is fitted into the cutout 18*a* of the front launching unit 2 from the bottom, the front face of the projection 3*a* of the back launching unit 2 comes in contact with the wall 18*b* of the front launching unit 2 and the right and left ribs 30*a* of the back launching unit 2 interlock with the right and left edges, respectively, of the cutout 18*a* of the front launching unit 2.

The two launching units 2 are thereby combined with each other. Releasing the projection 3*a* from the recess 3*b* causes the two launching units 2 to be separated from each other.

The projection 3*a* has a belt inlet 4*a* for the rack belt 20 and the wall 18*b* has a belt outlet 4*b* for the rack belt 20. When the two launching units 2 are combined with each other, the belt inlet 4*a* and belt outlet 4*b* of one launching unit 2 are aligned to the belt inlet 4*a* and belt outlet 4*b* of the other launching unit 2.

The casing 2*a* includes a disk spinning top holder 15 to be loaded with a spinning top 30. The spinning top holder 15 is mounted on the casing 2*a* around a rotating shaft 11. The spinning top holder 15 can idle around the rotating shaft 11. The spinning top holder 15 has two clicks 16 disposed symmetrically around the rotating shaft 11 on the bottom periphery. Each click 16 is arc-shaped in bottom view. The click 16 has a flat face 16*a* at the bottom end, a vertical face 16*b* at the head end in the rotating direction, and an inclined face 16*c* at the tail end in the rotating direction.

The casing 2*a* accommodates a spinning mechanism 10 for spinning the spinning top holder 15. The spinning mechanism 10 includes a pinion 12 and a clutch 13. The pinion 12 is fixed to the rotating shaft 11 and engageable with the teeth of the rack belt 20. The clutch 13 transmits rotative power from the pinion 12 to the spinning top holder 15.

The clutch 13 rotates together with the pinion 12. The clutch 13 is composed of a synthetic resin. The clutch 13 includes a hub 13*a* engaged with the rotating shaft 11 and two C-shaped protrusions 13*b* integrated with the hub 13*a*. Each protrusion 13*b* has a projection 13*c*. A cylinder 17 surrounding the clutch 13 is provided on the top periphery of the spinning top holder 15. The cylinder 17 has recesses 17*a* around the inner wall. The recesses 17*a* can be receive the projections 13*c*. Since each projection 13*c* is normally engaged with the recesses 17*a*, the rotation of the pinion 12 leads to the rotation of the clutch 13 and thus the rotation of the spinning top holder 15. An excess load leads to resilient deformation of the protrusion 13*b*, which precludes the power transmission from the pinion 12 to the clutch 13.

2. Spinning Top 30

In the present embodiment, two spinning tops 30 have an identical structure. In the circumstances, the same reference numeral is used for identical elements of two spinning tops 30 for avoiding redundancy in the description.

The spinning top 30 has two arc-shaped grooves 31 in the top face at the positions corresponding to the clicks 16 of the spinning top holder 15. In the present embodiment, the spinning top 30 has the arc-shaped grooves 31 with a tongue 32 inserted therein from the bottom; however, the spinning top 30 may have the arc-shaped grooves 31 without the tongue 32. The arc-shaped groove 31 is narrower at the side remote from the tongue 32. After the clicks 16 of the spinning top holder 15 are inserted into the clearances in the arc-shaped grooves 31 from the top, the spinning top 30 is rotated relative to the spinning top holder 15 such that the clicks 16 of the spinning top holder 15 are moved to the narrower sides of the arc-shaped grooves 31. A projection 16*d* on the inner face of the click 16 is then slid to the lower side of the upper wall of the spinning top 30, thereby the spinning top 30 is mounted in (held by) the spinning top holder 15.

3. Rack Belt 20

The rack belt 20 has teeth 21 on one side and a handle 22 at one end. The rack belt 20 is inserted into the combined launching device 1 through the belt inlet 4*a* of the casing 2*a*, so that the teeth 21 of the rack belt 20 are engaged with the pinions 12 of the two launching units 2.

(Use and Operation)

The operation of the combined launching device 1 with this structure will now be described.

Figure 3:
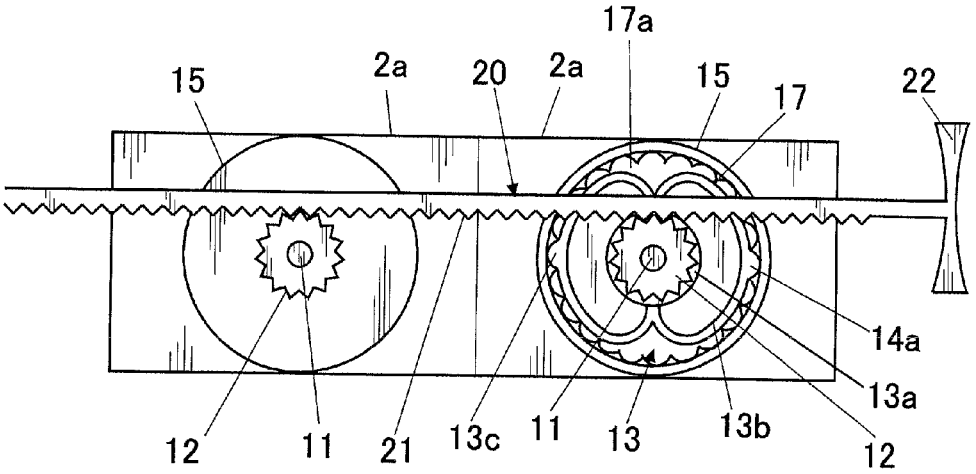
FIG. 3 is a schematic diagram illustrating the engagement of teeth of a rack belt with pinions in casings combined in the longitudinal direction.

After spinning tops 30 are mounted in the respective spinning top holders 15 of the two launching units 2, the rack belt 20 is introduced from the front launching unit 2 into the combined launching device 1 such that the front end of the rack belt 20 projects from the back launching unit 2, as shown in FIG. 3. Extraction of the rack belt 20 while the spinning top holders 15 of the two launching units 2 are facing down rotates the pinions 12 and transmits the rotary power to the spinning top holders 15 via the clutches 13 to rotate the spinning top holders 15.

Figure 4A:
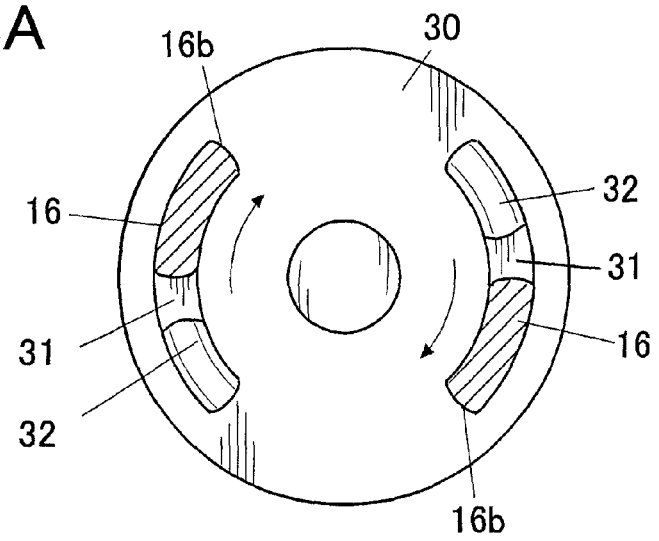
FIG. 4A is a schematic diagram illustrating the relationship between arc-shaped grooves in a spinning top and clicks of a spinning top holder while the spinning top holder is spinning.
Figure 4B:
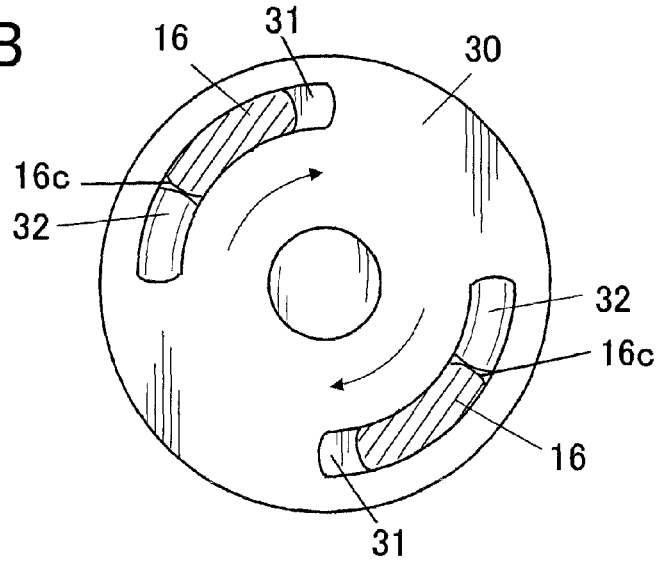
FIG. 4B is a schematic diagram illustrating the relationship between arc-shaped grooves in a spinning top and clicks of a spinning top holder while the spinning top holder is not spinning.

The rotary power is then transmitted from the spinning top holders 15 to the spinning tops 30 via the clicks 16. When the teeth 21 of the rack belt 20 are detached from the pinions 12, the pinions 12 stop the rotation. Since the spinning tops 30 continue to rotate due to the inertial force, the tongue 32 of the spinning tops 30 collide with the inclined faces 16*c*, as shown in FIG. 4B. The spinning tops 30 are then moved downward along the inclined faces 16*c* and finally launched downward from the spinning top holders 15 while spinning.

Figure 5:
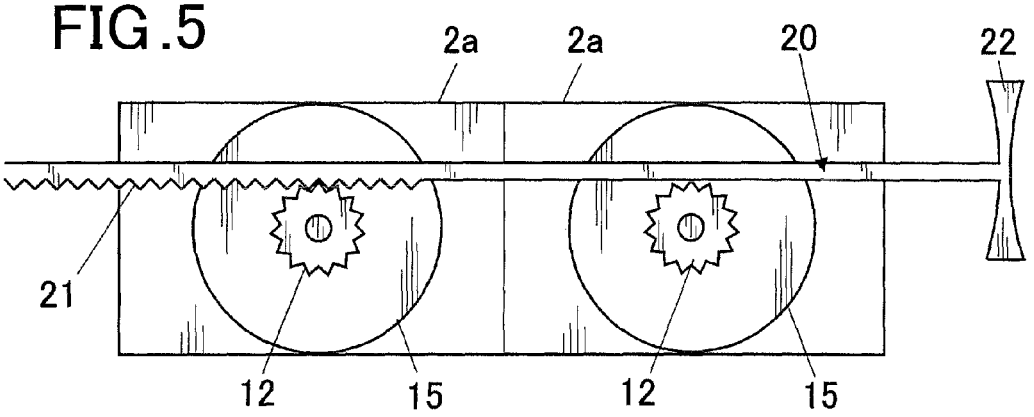
FIG. 5 is a schematic diagram illustrating an example positional relationship between teeth of a rack belt and the pinions in the casings combined in the longitudinal direction.

As shown in FIG. 3, when the two pinions 12 are rotated with one rack belt 20, the pinion 12 of the forward launching unit 2 is engaged with the teeth 21 for a longer period of time than that of the back launching unit 2. To equalize the engagement times of the two pinions 12, the teeth 21 of the rack belt 20 may be formed at the site far from the handle 22 such that the teeth 21 of the rack belt 20 are not engaged with the forward pinion 12 when the rack belt 20 is first positioned in the two casings 2*a*, as shown in FIG. 5.

<Another Embodiment>

Figure 6:
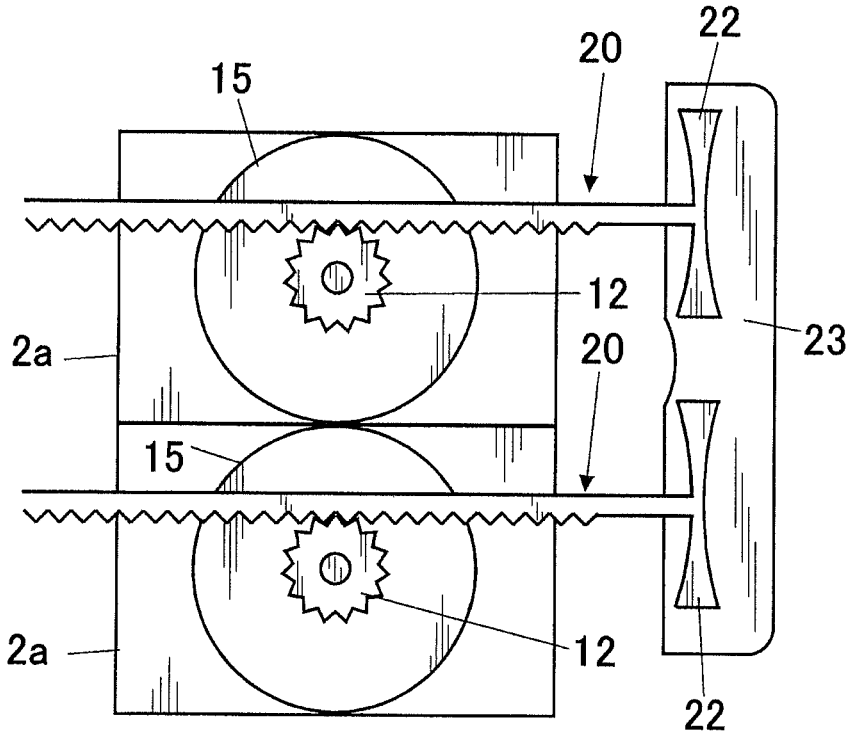
FIG. 6 is a schematic diagram illustrating the engagement of teeth of two rack belts with the respective pinions in the casings combined in the transverse direction, according to an alternate embodiment.

FIG. 6 illustrates another embodiment of the combined launching device 1 for launching spinning tops according to the present invention. In this combined launching device 1, the casings 2*a*, 2*a* are combined in the transverse direction, and the pinions 12 are engaged with the teeth 21 of different rack belts 20. In this case, it is preferable that the rack belts 20 be disposed in parallel, and the handles 22 of the two rack belts 20 be integrated into one coupling grip 23. With this structure, the rack belts 20 can be simultaneously operated by pulling the coupling grip 23.

<Modifications of Invention>

The embodiments of the present invention have been described above. It should be understood that the present invention is not limited to these embodiments and various modifications can be made within the scope of the invention.

For example, the projection 3*a* and the recess 3*b* are provided as couplers in the above embodiment. Instead, magnets can be used as couplers. Alternatively, one launching unit 2 may have a first suit of a projection and a recess as a coupler and the other launching unit 2 may have a second suit of a projection and a recess as another coupler such that the two launching units 2 are combined with each other by engaging the first suit of a projection and a recess with the second suit of a projection and a recess. Alternatively, one launching unit 2 may have a dovetail as a coupler and the other launching unit 2 may have a socket as another coupler such that the two launching units 2 are combined with each other by engaging the dovetail with the socket. In an alternative embodiment, one launching unit 2 has a semicircular plate as a coupler at the axis and the other launching unit 2 has a semicircular pocket as another coupler such that the two launching units 2 are combined with each other by relatively rotating the two launching units 2 around the axis.

This U.S. patent application claims priority to Japanese patent application No. 2015-245219 filed on Dec. 16, 2015, the entire contents of which are incorporated by reference herein.

What is claimed is:

1. A device for launching spinning tops, comprising:

a first launcher having— a first spinning top holder for holding a first top, a first pinion having teeth and being operatively connected to the first spinning top holder, a first coupler, and an opening extending through the first coupler and the first launcher;

a second launcher having— a second spinning top holder for holding a second top, a second pinion having teeth and being operatively connected to the second spinning top holder, wherein the first and second pinions are arranged along a first line, a second coupler, and an opening extending through the second coupler and the second launcher, wherein the first and second couplers removably connect the first and second launchers in series along the first line, wherein the openings are arranged along a second line parallel to the first line; and an operating member that has a handle, a linear projection with a first portion and a second portion, and an edge extending along the first and second portions, wherein the first portion is closest to the handle and the second portion is spaced from the handle by the first portion, wherein the edge at the second portion includes a number of teeth and the edge at the first portion is flat, and wherein the operating member is movable within the openings from a first position wherein the teeth on the edge of the second portion engage the teeth of the second pinion to turn the second pinion, but the flat edge on the first portion does not engage the teeth of the first pinion, to a second position wherein the teeth on the edge of the second portion engage the teeth of the first and second pinions to turn the first and second pinions, and to outside the device, and wherein the teeth of the first pinion and the teeth of the second pinion only contact the same number of teeth of the operating member as the operating member moves from the first position to outside the device.

2. A device for launching spinning tops, comprising:

a first launcher having— a first spinning top holder for holding a first top, a first pinion having teeth and being operatively connected to the first spinning top holder, a first coupler formed on an end surface of the first launcher, and an opening extending through the end surface and the first launcher;

a second launcher having— a second spinning top holder for holding a second top, a second pinion having teeth and being operatively connected to the second spinning top holder, wherein the first and second pinions are arranged along a first line, a second coupler formed on an end surface of the second launcher, and an opening extending through the end surface and the second launcher, wherein the first and second couplers removably connect the first and second launchers in series along the first line, wherein the openings are arranged along a second line parallel to the first line; and an operating member having a first portion, a second portion and an edge extending along the first and second portions, wherein the edge at only the second portion includes a number of teeth, wherein the operating member is received within the openings along the second line, wherein the operating member is movable within the openings between a first position where the teeth on the second portion are received only in the teeth of the second pinion, a second position where the teeth on the second portion are engaged with the teeth on the both of the first and second pinions, and a third position wherein the teeth on the second portion are disengaged from the teeth of both of the first and second pinions and the operating member is separated from the device, and wherein, as the operating member moves from the first position to the third position, the teeth of the first pinion and the teeth of the second pinion only contact the same number of teeth of the operating member.

* * * * *